US006164013A

United States Patent [19]

Ramsey

[11] Patent Number: 6,164,013

[45] Date of Patent: Dec. 26, 2000

[54] PORTABLE SIDE PET DOOR

[76] Inventor: Troy Ramsey, 2201 Manhattan Blvd., #F-241, Harvey, La. 70058

[21] Appl. No.: 09/329,177

[22] Filed: Jun. 10, 1999

[51] Int. Cl.[7] ..... E06B 7/00; E06B 7/28; E05D 15/48

[52] U.S. Cl. ..... 49/70; 49/169

[58] Field of Search ..... 49/70, 501, 168, 49/169, 37, 56; 52/27

[56] References Cited

U.S. PATENT DOCUMENTS

| | | | |
|---|---|---|---|
| 4,103,458 | 8/1978 | Booker | 49/56 |
| 4,738,053 | 4/1988 | Biesenthal | 49/70 |
| 5,927,011 | 7/1999 | Sickenius | 49/70 X |
| 5,946,855 | 9/1999 | Miconi | 49/168 X |

*Primary Examiner*—Daniel P. Stodola
*Assistant Examiner*—Hugh B. Thompson

[57] ABSTRACT

A portable side pet door for mounting in the opening between a door frame and an ajar door to provide a passage for pets to pass through without having to make a hole through the door. The portable side pet door includes a side panel with a side door channel in a first face of the side panel. The side door channel extends adjacent a first side edge of the side panel between top and bottom edges of the side panel. The side panel has a pet hole extending therethrough and positioned adjacent the bottom edge of the side panel. A top panel has an upper door channel in a lower face of the top panel which extends along one side of the top panel.

7 Claims, 3 Drawing Sheets

PORTABLE SIDE PET DOOR

BACKGROUND OF THE INVENTION

1. Field of the Invention

The present invention relates to pet door assemblies and more particularly pertains to a new portable side pet door for mounting in the opening between a door frame and an ajar door to provide a passage for pets to pass through without having to make a hole through the door.

2. Description of the Prior Art

The use of pet door assemblies is known in the prior art. More specifically, pet door assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,660,144; U.S. Pat. No. 4,408,416; U.S. Pat. No. Des. 334,431; U.S. Pat. No. 3,152,577; U.S. Pat. No. 3,654,733; and U.S. Pat. No. 3,811,224.

While these devices fulfill their respective, particular objectives and requirements, the aforementioned patents do not disclose a new portable side pet door. The inventive device includes a side panel with a side door channel in a first face of the side panel. The side door channel extends adjacent a first side edge of the side panel between top and bottom edges of the side panel. The side panel has a pet hole extending therethrough and positioned adjacent the bottom edge of the side panel. A top panel has an upper door channel in a lower face of the top panel which extends along one side of the top panel.

In these respects, the portable side pet door according to the present invention substantially departs from the conventional concepts and designs of the prior art, and in so doing provides an apparatus primarily developed for the purpose of mounting in the opening between a door frame and an ajar door to provide a passage for pets to pass through without having to make a hole through the door.

SUMMARY OF THE INVENTION

In view of the foregoing disadvantages inherent in the known types of pet door assemblies now present in the prior art, the present invention provides a new portable side pet door construction wherein the same can be utilized for mounting in the opening between a door frame and an ajar door to provide a passage for pets to pass through without having to make a hole through the door.

The general purpose of the present invention, which will be described subsequently in greater detail, is to provide a new portable side pet door apparatus and method which has many of the advantages of the pet door assemblies mentioned heretofore and many novel features that result in a new portable side pet door which is not anticipated, rendered obvious, suggested, or even implied by any of the prior art pet door assemblies, either alone or in any combination thereof.

To attain this, the present invention generally comprises a side panel with a side door channel in a first face of the side panel. The side door channel extends adjacent a first side edge of the side panel between top and bottom edges of the side panel. The side panel has a pet hole extending therethrough and positioned adjacent the bottom edge of the side panel. A top panel has an upper door channel in a lower face of the top panel which extends along one side of the top panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new portable side pet door apparatus and method which has many of the advantages of the pet door assemblies mentioned heretofore and many novel features that result in a new portable side pet door which is not anticipated, rendered obvious, suggested, or even implied by any of the prior art pet door assemblies, either alone or in any combination thereof.

It is another object of the present invention to provide a new portable side pet door which may be easily and efficiently manufactured and marketed.

It is a further object of the present invention to provide a new portable side pet door which is of a durable and reliable construction.

An even further object of the present invention is to provide a new portable side pet door which is susceptible of a low cost of manufacture with regard to both materials and labor, and which accordingly is then susceptible of low prices of sale to the consuming public, thereby making such portable side pet door economically available to the buying public.

Still yet another object of the present invention is to provide a new portable side pet door which provides in the apparatuses and methods of the prior art some of the advantages thereof, while simultaneously overcoming some of the disadvantages normally associated therewith.

Still another object of the present invention is to provide a new portable side pet door for mounting in the opening between a door frame and an ajar door to provide a passage for pets to pass through without having to make a hole through the door.

Yet another object of the present invention is to provide a new portable side pet door which includes a side panel with a side door channel in a first face of the side panel. The side door channel extends adjacent a first side edge of the side panel between top and bottom edges of the side panel. The side panel has a pet hole extending therethrough and positioned adjacent the bottom edge of the side panel. A top panel has an upper door channel in a lower face of the top panel which extends along one side of the top panel.

Still yet another object of the present invention is to provide a new portable side pet door that allows a user to quickly and easily install a pet door at any door structure such as when the user is at an hotel without damaging or altering the pre-existing door.

Even still another object of the present invention is to provide a new portable side pet door that light weight and easy to disassemble for convenient storage and transport.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
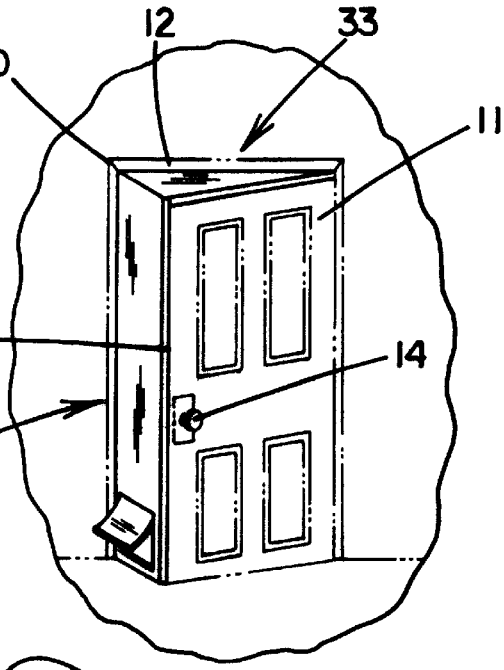
FIG. 1 is a schematic perspective view of a new portable side pet door in use according to the present invention.

With reference now to the drawings, and in particular to FIGS. 1 through 5 thereof, a new portable side pet door embodying the principles and concepts of the present invention and generally designated by the reference numeral 10 will be described.

As best illustrated in FIGS. 1 through 5, the portable side pet door 10 generally comprises a side panel with a side door channel in a first face of the side panel. The side door channel extends adjacent a first side edge of the side panel between top and bottom edges of the side panel. The side panel has a pet hole extending therethrough and positioned adjacent the bottom edge of the side panel. A top panel has an upper door channel in a lower face of the top panel which extends along one side of the top panel.

In use, the pet door assembly is designed for installation in a space formed between a door frame and an ajar door pivotally coupled to the door frame. Specifically, as best illustrated in FIG. 1, the pet door assembly is designed for use with a structure having a door frame 10 defining a doorway through the structure and a door 11 pivotally coupled to the door frame along a substantially vertical side edge of the door to permit closing of the doorway. The door frame preferably has a molding 12 extending therearound and outwardly from a wall surface of the structure.

The door has substantially horizontal top and bottom edges, and a substantially vertical free side edge 13 extending between the top and bottom edges of the door and located opposite the pivotally coupled side edge of the door. Typically, the door has a lockset adjacent the free edge of the door and which includes a doorknob 14 outwardly extending from the door and a retractable latch 15 outwardly extending from the free side edge of the door. A side region of the door frame has a corresponding receptacle therein designed for receiving the latch of the lockset when the door closes the doorway.

To use the pet door assembly, the door must first be pivoted away from the door frame such that a space is defined between the free side edge of the door and a substantially vertical elongate side region of the door frame and between a top region of the door frame and the top edge 16 of the door.

In closer detail, the pet door assembly includes a generally rectangular side panel 17 having a pair of substantially planar generally rectangular faces 18,19 and a generally rectangular outer perimeter comprising substantially parallel top and bottom edges 20,21, and a pair of substantially parallel side edges 22,23 extending substantially perpendicular to the top and bottom edges of the side panel.

Figure 5:
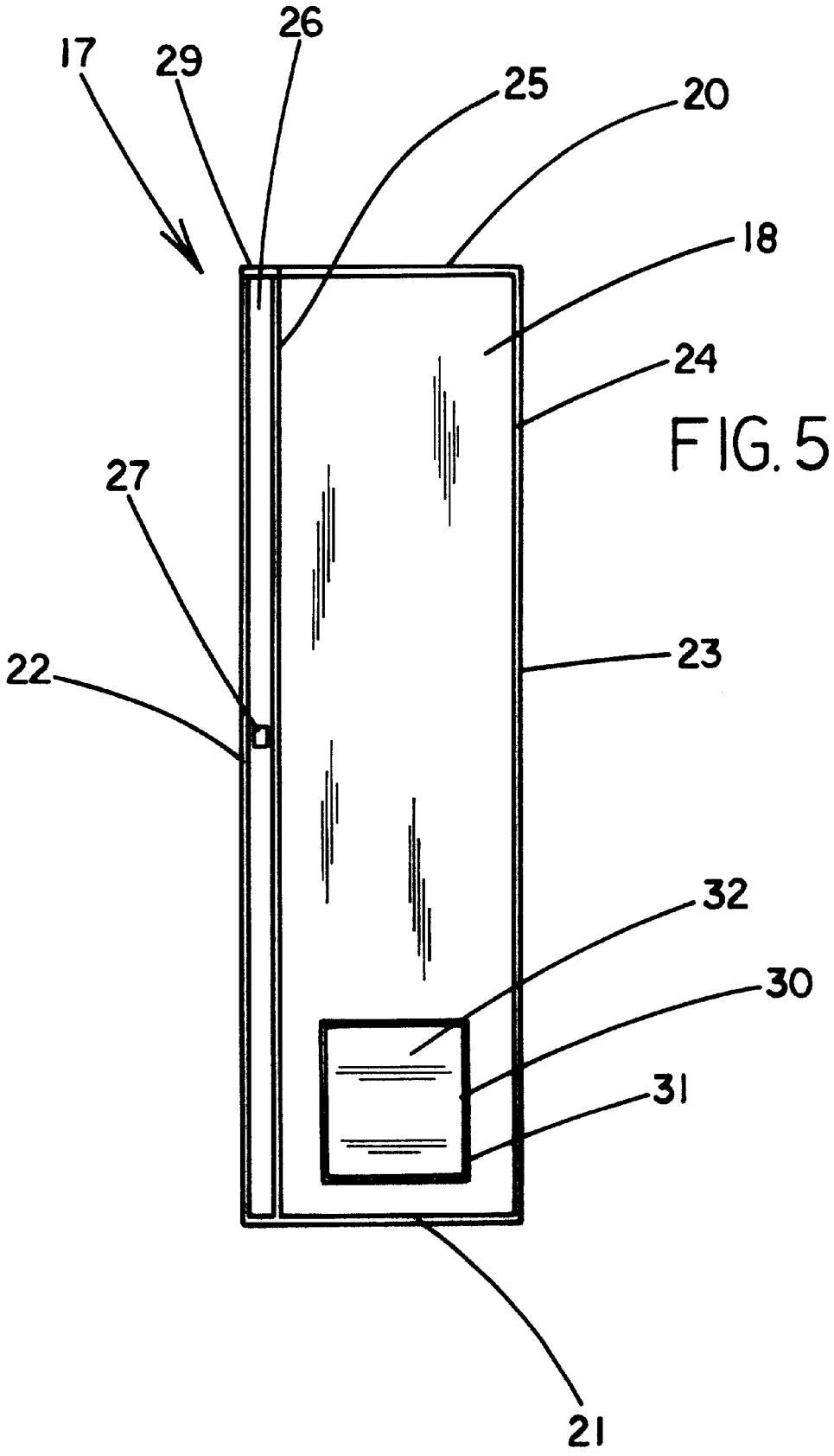
FIG. 5 is a schematic plan view of the first face of the side panel.

A first of the faces of the side panel has an outwardly extending perimeter wall 24 extending around the outer perimeter of the side panel. The first face of the side panel has an outwardly extending elongate channel wall 25 extending between the top and bottom edges of the side panel. As best illustrated in FIG. 5, the channel wall is positioned towards and extended substantially parallel to a first of the side edges 22 of the side panel. The channel wall and an elongate first side portion of the perimeter wall extending along the first side edge of the side panel are extended substantially parallel to one another and define an elongate side door channel 26 therebetween.

Figure 4:
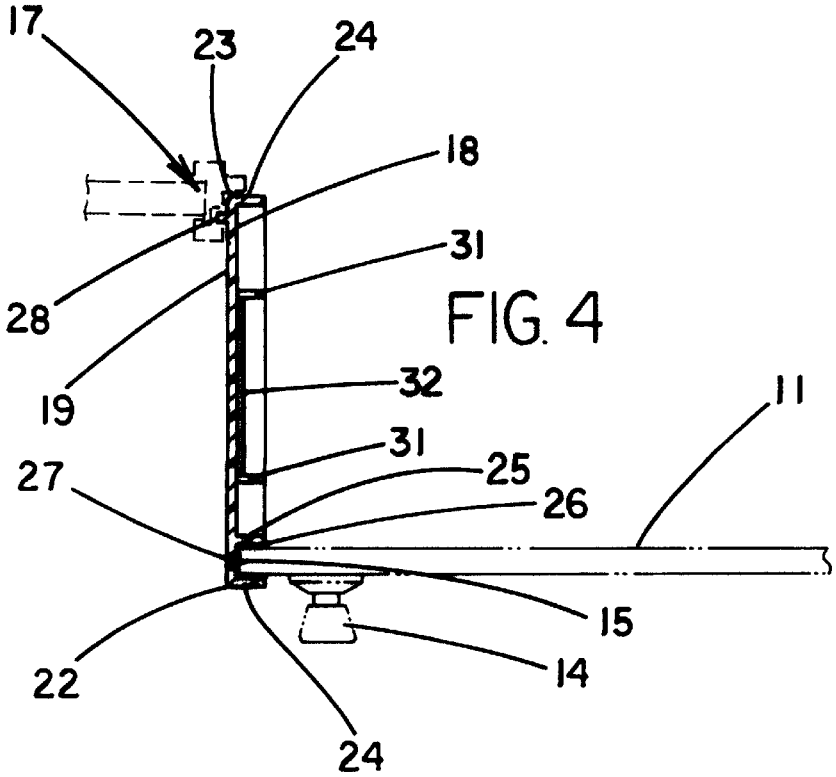
FIG. 4 is a schematic cross sectional view of the side panel taken from line 4—4 of FIG. 2.

In use, as best illustrated in FIGS. 1 and 4, the side panel is positioned in the space defined between the side region of the door frame and the free side edge of the door. The side door channel of the side panel receives therein the free side edge of the door. The top edge of the side panel is positioned adjacently above the top edge of the door and the bottom edge of the side panel is positioned adjacently below the bottom edge of the door. An elongate second side portion of the perimeter wall extending along a second of the side edges 23 of the side panel is positioned adjacent the side region of the door frame such that a second of the faces of the panel abuts the side region of the door frame.

Preferably, the side panel has a generally rectangular aperture 27 extending therethrough between the faces of the side panel and positioned between the first side portion of the perimeter wall and the channel wall to provide an opening through the side panel into the side door channel. The aperture is ideally located at a midpoint equidistant positioned between the top and bottom edges of the side panel. The aperture of the side panel receives therein the latch of the lockset of the door.

Figure 2:
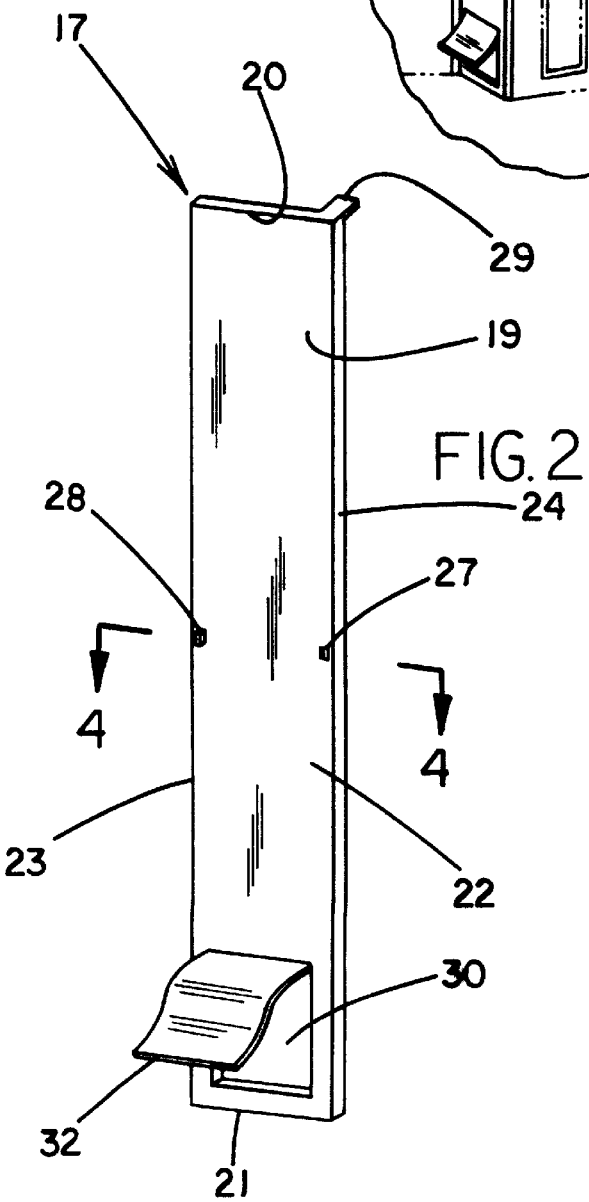
FIG. 2 is a schematic perspective view of the side panel.

Even more preferably, a second of the faces of the side panel has an outwardly extending side extent 28 positioned adjacent the second side edge of the side panel as depicted in FIGS. 2 and 4. The side extent is also ideally located at a midpoint equidistant positioned between the top and bottom edges of the side panel. In use, the side extent is inserted into the receptacle of the side region of the door frame.

Ideally, the perimeter wall of the side panel has a generally rectangular top extent 29 outwardly extending from a top region of the perimeter wall extending along the top edge of the side panel. As best shown in FIGS. 2 and 5, the top extent of the side panel is positioned adjacent the first side edge of the panel. In use, the top extent of the side panel is rested on the top edge of the door adjacent the free side edge of the door.

In use, the side door channel, the aperture, the side extent, and the top extent are all designed to work in tandem helping hold the side panel in position in the space between the door frame and the ajar door.

The side panel has a generally rectangular pet hole 30 extending therethrough between the faces of the side panel. The pet hole is positioned adjacent the bottom edge of the side panel. The pet hole is ideally positioned substantially equidistant between the side edges of the side panel. In use, the pet hole is designed for and of sufficient size for permitting a pet to pass through the side panel.

Preferably, the pet hole has a generally rectangular outer periphery comprising substantially parallel horizontal upper and lower portions, and a pair of substantially parallel vertical side portions extending between the upper and lower portions of the pet hole. Even more preferably, the first face of the side panel has an outwardly extending generally rectangular perimeter lip 31 extending around the outer periphery of the pet hole. The perimeter lip helps provide additionally structural strength to the side panel to help prevent cracks from forming adjacent the periphery of the pet hole (especially in the corners of the pet hole).

Preferably, a generally rectangular flexible cover flap 32 substantially covers the pet hole. The cover flap is pivotally coupled to the top portion of the pet hole. The cover flap permits passage of a pet through the pet hole while helping minimize drafts through the pet hole.

Figure 3:
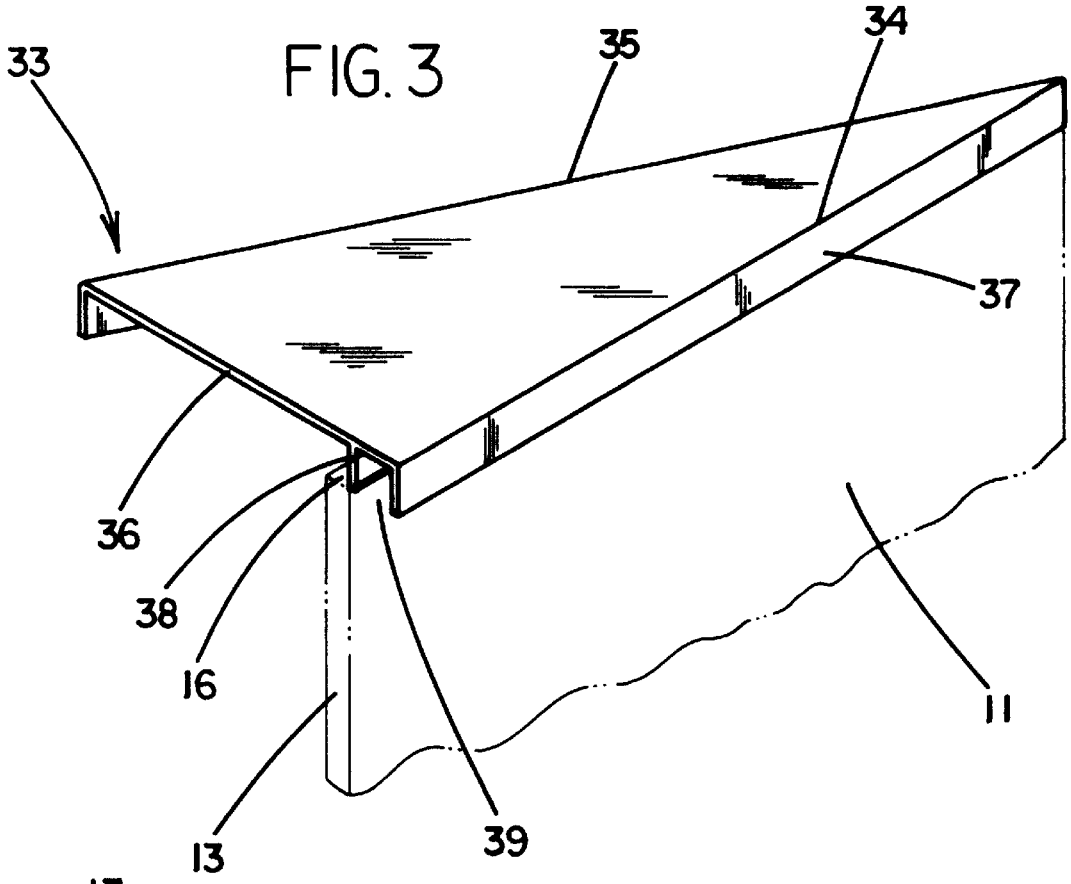
FIG. 3 is a schematic perspective view of the top panel.

With particular reference to FIG. 3, the pet door assembly also includes a generally triangular top panel 33 having has substantially planar generally triangular upper and lower faces, and an outer perimeter comprising three sides 34,35, 36. The lower face of the top panel has a downwardly extending side wall 37 extending along first and second sides 34,35 of the three sides of the top panel.

The lower face of the top panel also has a downwardly extending channel wall 38 extending substantially parallel to the first side of the top panel. The channel wall of the top panel is spaced apart from a first side portion of the side wall of the top panel to define an upper door channel 39 therebetween.

In use, the upper door channel of the top panel receives the top edge of the door therein so that a second side portion of the side wall of the top panel extending along the second side of the top panel may be rested on a portion of the molding of the door frame extending along a top region of the door frame. A third side 36 of the three sides of the top panel is positioned adjacent the top edge of the side panel and extends between the door frame and the door.

As best shown in FIG. 1, the side panel substantially covers a side region of the space between the door frame and the door while the top panel substantially covers a top region of the space between the door frame and the door. Ideally, the side and top panels comprise a molded plastic material for durability and lighter weight. In an ideal illustrative embodiment, the side panel has a length defined between the top and bottom edges of the side panel between about 6 feet and about 8 feet and a width defined between the side edges of the side panel of about 16 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pet door assembly for installation in a space formed between a door frame and an ajar door pivotally coupled to the door frame, said pet door assembly comprising:

a side panel having a pair of faces and an outer perimeter comprising top and bottom edges, and a pair of side edges;

a first of said faces of said side panel having a U-shared side door channel extending adjacent a first side edge of said side panel between said top and bottom edges of said side panel;

said side panel having a pet hole extending therethrough between said faces of said side panel, said pet hole being positioned adjacent said bottom edge of said side panel;

wherein said side panel has an aperture therethrough into said side door channel, said aperture of said side panel being adapted for receiving therein a latch of a lockset of said door to removably secure said side panel to said door, said aperture being located at a position approximately equidistantly spaced between said top and bottom edges of said side panel; and wherein a second of said faces of said side panel has an outwardly extending side extent positioned adjacent said second side edge of said side panel, said side extent being adapted for insertion into a receptacle of a side region of a door frame, said side extent being located at a position approximately equidistantly spaced between said top and bottom edges of said side panel.

2. The pet door assembly of claim 1, further comprising a top panel having upper and lower faces, and an outer perimeter comprising three sides, said lower face of said top panel having an upper door channel extending along a first of said sides of said top panel.

3. The pet door assembly of claim 1, wherein said first face of said side panel has an outwardly extending perimeter wall extending around said outer perimeter of said side panel.

4. The pet door assembly of claim 1, wherein said first face of said side panel having a top extent outwardly extending from said top edge of said side panel, said top extent of said side panel being positioned adjacent said first side edge of said panel, said top extent of said side panel being adapted for resting on a top edge of a door adjacent a free side edge of the door.

5. The pet door assembly of claim 1, wherein said first face of said side panel has an outwardly extending perimeter lip extending around an outer periphery of said pet hole.

6. The pet door assembly of claim 1, further comprising a cover flap substantially covering said pet hole and pivotally coupled to said side panel.

7. A pet door assembly system for installation in a space formed between a door frame and an ajar door pivotally coupled to the door frame, said pet door assembly system comprising:

a structure having a door frame defining a doorway through said structure and a door pivotally coupled to the door frame along a substantially vertical side edge of said door to permit closing of said doorway;

said door frame having a molding extending therearound and outwardly from a wall surface of said structure;

said door having substantially horizontal top and bottom edges, and a substantially vertical free side edge extending between said top and bottom edges of said door and located opposite said pivotally coupled side edge of said door;

said door having a lockset adjacent said free edge of said door, said lockset having a doorknob outwardly extending from said door and a retractable latch outwardly extending from said free side edge of said door;

said door being pivoted away from said door frame such that a space is defined between said free side edges of said door and a substantially vertical elongate side region of said door frame;

said side region of said door frame having a receptacle therein adapted for receiving said latch of said lockset When said door closes said doorway;

a pet door assembly comprising:

a generally rectangular side panel having a pair of substantially planar generally rectangular faces and a generally rectangular outer perimeter comprising substantially parallel top and bottom edges, and a pair of substantially parallel side edges extending substantially perpendicular to said top and bottom edges of said side panel;

a first of said faces of said side panel having an outwardly extending perimeter wall extending around said outer perimeter of said side panel;

said first face of said side panel having an outwardly extending elongate channel wall extending between said top and bottom edges of said side panel, said channel wall being positioned towards and extended substantially parallel to a first of said side edges of said side panel;

said channel wall and an elongate first side portion of said perimeter wall extending along said first side edge of said side panel being extended substantially parallel to one another and defining an elongate side door channel therebetween;

said side panel being positioned in said space defined between said side region of said door frame and said free side edge of said door;

said side door channel of said side panel receiving therein said free side edge of said door;

said top edge of said side panel being positioned adjacently above said top edge of said door, said bottom edge of said side panel being positioned adjacently below said bottom edge of said door;

an elongate second side portion of said perimeter wall extending along a second of said side edges of said side panel being positioned adjacent said side region of said door frame such that said faces of said panel abuts said side region of said door frame;

said side panel having a generally rectangular aperture extending therethrough between said faces of said side panel and positioned between said first side portion of said perimeter wall and said channel wall to provide an opening through said side panel into said side door channel;

said aperture being located at a position approximately equidistantly spaced between said top and bottom edges of said side panel;

said aperture of said side panel receiving therein said latch of said lockset of said door to removably secure said side panel to said door;

a second of said faces of said side panel having an outwardly extending side extent positioned adjacent said second side edge of said side panel;

said side extent being located at a position approximately equidistantly spaced between said top and bottom edges of said side panel;

said side extent being inserted into said receptacle of said side region of said door frame;

said door channel, said aperture and said side extent being adapted for helping hold said side panel in position in the space between the door frame and the ajar door;

said perimeter wall of said side panel having a generally rectangular top extent outwardly extending from a top region of said perimeter wall extending along said top edge of said side panel, said top extent of said side panel being positioned adjacent said first side edge of said panel;

said top extent of said side panel being rested on said top edge of said door adjacent said free side edge of said door;

said side panel having a generally rectangular pet hole extending therethrough between said faces of said side panel, said pet hole being positioned adjacent said bottom edge of said side panel;

said pet hole being positioned substantially equidistant between said side edges of said side panel;

said pet hole being adapted for permitting a pet to pass through said side panel;

said pet hole having a generally rectangular outer periphery comprising substantially parallel upper and lower portions, and a pair of substantially parallel side portions extending between said upper and lower portions of said pet hole;

said first face of said side panel having an outwardly extending generally rectangular perimeter lip extending around said outer periphery of said pet hole;

a generally rectangular flexible cover flap substantially covering said pet hole;

said cover flap being pivotally coupled to said top portion of said pet hole;

said cover flap permitting passage of a pet through said pet hole while helping minimize drafts through said pet hole;

a generally triangular top panel having substantially planar generally triangular upper and lower faces, and an outer perimeter comprising three sides;

said lower face of said top panel having a downwardly extending side wall extending along first and second sides of said three sides of said top panel;

said lower face of said top panel having a downwardly extending channel wall extending substantially parallel to said first side of said top panel;

said channel wall of said top panel being spaced apart from a first side portion of said side wall of said top panel to define an upper door channel therebetween;

said upper door channel of said top panel receiving said top edge of said door therein, a second side portion of said side wall of said top panel extending along said second side of said top panel being rested on a portion of said molding of said door frame extending along a top region of said door frame;

a third side of said three sides of said top panel being positioned adjacent said top edge of said side panel and extending between said door frame and said door;

said side panel substantially covering a side region of said space between said door frame and said door, said top panel substantially covering a top region of said space between said door frame and said door;

said side and top panels comprising a molded plastic material for durability and lighter weight; and wherein said side panel has a length defined between said top and bottom edges of said side panel between about 6 feet and 8 feet and a width defined between said side edges of said side panel of about 16 inches.

* * * * *